US011599045B1

(12) United States Patent
Yoshioka et al.

(10) Patent No.: US 11,599,045 B1
(45) Date of Patent: Mar. 7, 2023

(54) TRANSFER DEVICE AND IMAGE FORMING APPARATUS HAVING NIP MEMBER WITH PREDETERMINED GEOMETRY

(71) Applicant: FUJIFILM BUSINESS INNOVATION CORP., Tokyo (JP)

(72) Inventors: Tomoaki Yoshioka, Kanagawa (JP); Kazuyoshi Hagiwara, Kanagawa (JP); Kazuki Kishi, Kanagawa (JP); Yoko Miyamoto, Kanagawa (JP); Toshiaki Baba, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/556,537

(22) Filed: Dec. 20, 2021

(30) Foreign Application Priority Data

Aug. 25, 2021 (JP) ..... JP2021-137608

(51) Int. Cl.

| | |
|---|---|
| ***G03G 15/16*** | (2006.01) |
| ***G03G 15/01*** | (2006.01) |
| ***G03G 15/20*** | (2006.01) |
| ***G03G 15/00*** | (2006.01) |

(52) U.S. Cl.
CPC ..... *G03G 15/1685* (2013.01); *G03G 15/0131* (2013.01); *G03G 15/167* (2013.01); *G03G 15/1665* (2013.01); *G03G 15/1675* (2013.01); *G03G 15/2028* (2013.01); *G03G 15/657* (2013.01); *G03G 15/6558* (2013.01); *G03G 2215/00409* (2013.01); *G03G 2215/00413* (2013.01); *G03G 2215/00679* (2013.01); *G03G 2221/1639* (2013.01); *G03G 2221/1642* (2013.01); *G03G 2221/1672* (2013.01)

(58) Field of Classification Search
CPC ..... G03G 15/0131; G03G 15/1665; G03G 15/167; G03G 15/1675; G03G 15/1685; G03G 15/2028; G03G 15/6558; G03G 15/657; G03G 2215/00409; G03G 2215/00413; G03G 2215/00679; G03G 2221/1639; G03G 2221/1642; G03G 2221/1672
See application file for complete search history.

(56) References Cited

U.S. PATENT DOCUMENTS

2013/0223896 A1* 8/2013 Nishide ..... G03G 15/1665 399/304

FOREIGN PATENT DOCUMENTS

JP S58-005769 A 1/1983

* cited by examiner

*Primary Examiner* — Joseph S Wong
(74) *Attorney, Agent, or Firm* — Oliff PLC

(57) ABSTRACT

A transfer device includes: a transfer drum that has a groove-like recess extending in an axial direction in an outer circumferential portion thereof, rotates about an axis thereof, and comes into contact with a medium being transported at a portion thereof on an upstream side of the recess in a rotation direction; a nip member, the nip member and the transfer drum forming therebetween a nip part where the medium is nipped; an application member that applies a voltage to the nip part where the medium is nipped, so that an image is transferred to the medium; and a contact mechanism that causes the nip member to come into contact only with a portion on the upstream side of the recess in the transfer drum in the rotation direction at a transfer-start time when the transfer of the image to the medium starts.

5 Claims, 12 Drawing Sheets

TRANSFER DEVICE AND IMAGE FORMING APPARATUS HAVING NIP MEMBER WITH PREDETERMINED GEOMETRY

CROSS-REFERENCE TO RELATED APPLICATIONS

This application is based on and claims priority under 35 USC 119 from Japanese Patent Application No. 2021-137608 filed Aug. 25, 2021.

BACKGROUND

(i) Technical Field

The present disclosure relates to a transfer device and an image forming apparatus.

(ii) Related Art

Japanese Unexamined Patent Application Publication No. 58-5769 discloses a transfer device that transfers an image on an image carrier. The transfer device includes: a transfer-material transport member that moves a transfer material along a circulating path in an endless manner; a gripper piece that is attached to the transport member, that is supported by a rotary shaft so as to rotate relative to a base member, and that grips the leading edge of the transfer material; and a switch member attached to the base member. A portion of the gripper piece corresponding to the position of the switch member is cut away to detect the presence of the transfer material in the gripper.

SUMMARY

Aspects of non-limiting embodiments of the present disclosure relate to preventing a transfer error due to splitting of a transfer current when an image is transferred to a medium.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a transfer device including: a transfer drum that has a groove-like recess extending in an axial direction in an outer circumferential portion thereof, rotates about an axis thereof, and comes into contact with a medium being transported at a portion thereof on an upstream side of the recess in a rotation direction; a nip member, the nip member and the transfer drum forming therebetween a nip part where the medium is nipped; an application member that applies a voltage to the nip part where the medium is nipped, so that an image is transferred to the medium; and a contact mechanism that causes the nip member to come into contact only with a portion on the upstream side of the recess in the transfer drum in the rotation direction at a transfer-start time when the transfer of the image to the medium starts.

BRIEF DESCRIPTION OF THE DRAWINGS

Exemplary embodiments of the present disclosure will be described in detail based on the following figures, wherein.

DETAILED DESCRIPTION

Figure 1:
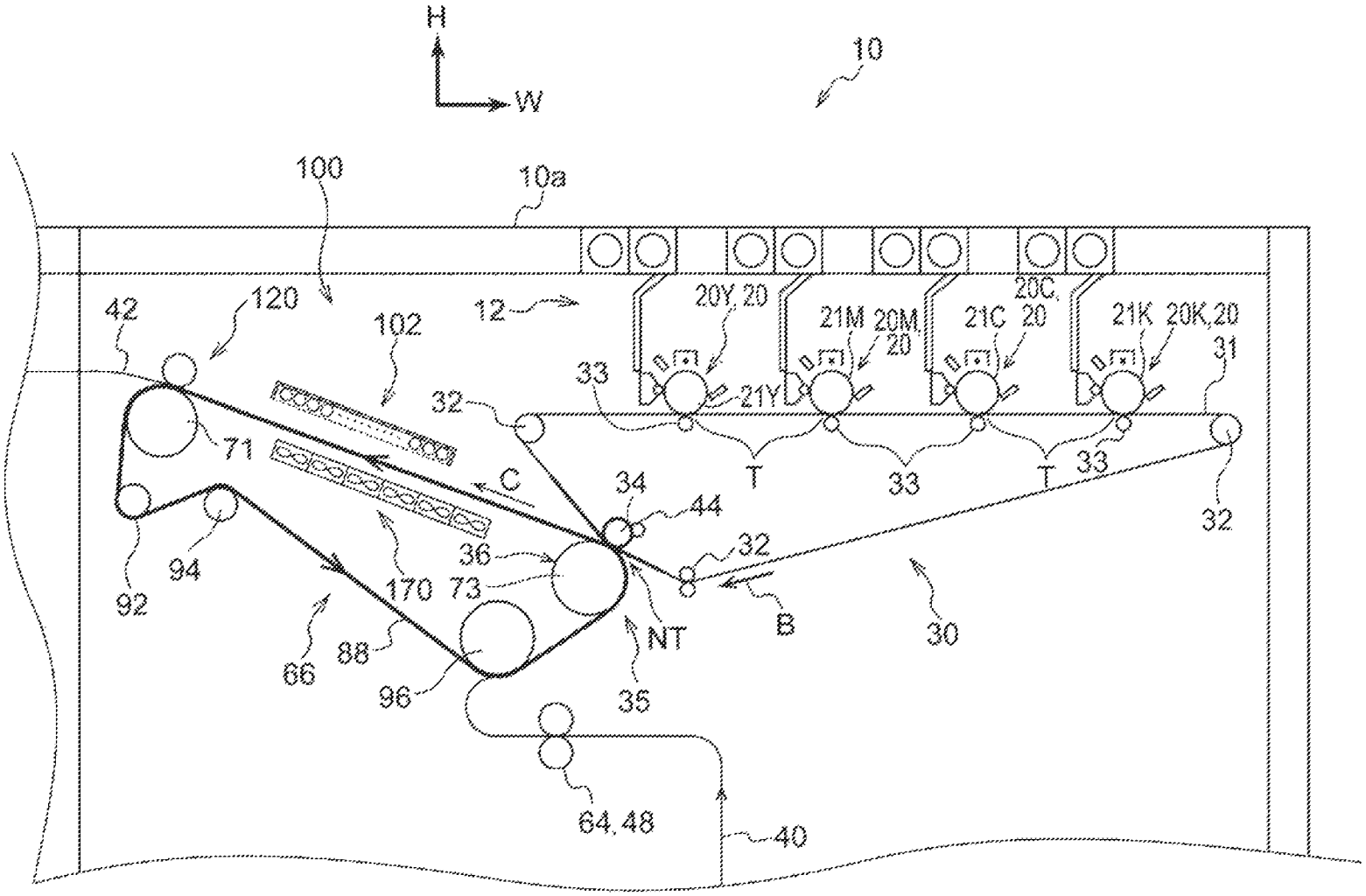
FIG. 1 is a schematic front view of a transfer device, a fixing device, and a chain gripper according to a first exemplary embodiment of the present disclosure.

An example of a transfer device and an example of an image forming apparatus according to a first exemplary embodiment of the present disclosure will be described with reference to FIGS. 1 to 11. The arrows H, W, and D in the drawings represent the top-bottom direction (vertical direction), the width direction (horizontal direction), and the depth direction (horizontal direction) of the apparatus.

Image Forming Apparatus 10

Figure 10:
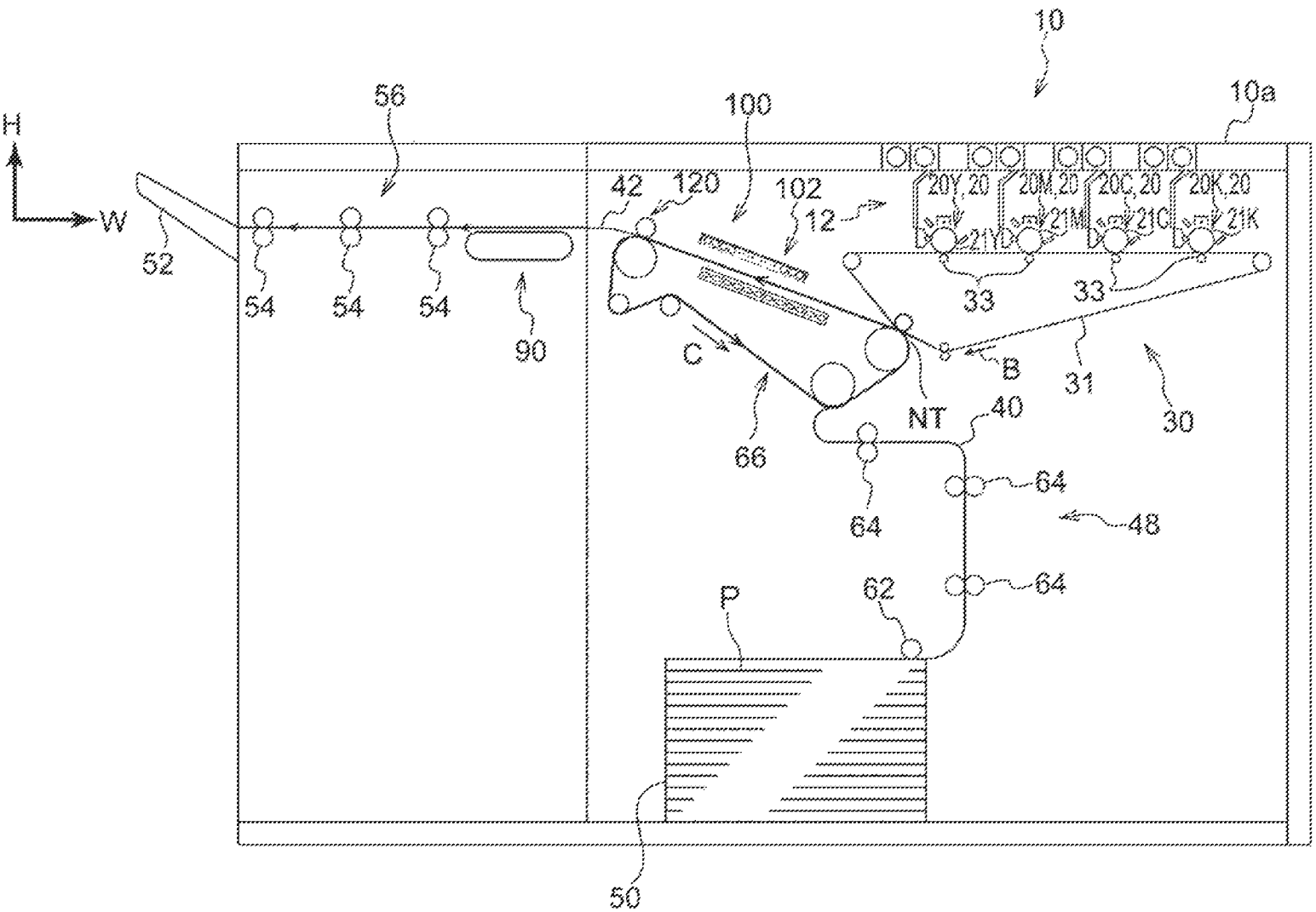
FIG. 10 is a schematic front view showing the configuration of an image forming apparatus according to the first exemplary embodiment of the present disclosure.

An image forming apparatus 10 according to this exemplary embodiment is an electrophotographic image forming apparatus, which forms a toner image on a sheet member P, serving as a medium. As shown in FIG. 10, the image forming apparatus 10 includes a storage part 50, a paper feed mechanism 48, a chain gripper 66, a transfer device 30, an image forming unit 12, a fixing device 100, a cooling unit 90, a paper output mechanism 56, and an output part 52.

Storage Part 50

The storage part 50 accommodates sheet members P.

Paper Feed Mechanism 48

The paper feed mechanism 48 transports a sheet member P stored in the storage part 50 to the chain gripper 66 (described below).

More specifically, as shown in FIG. 10, the paper feed mechanism 48 includes a feed roller 62 and multiple transport rollers 64 that transport the sheet member P along a paper feed path 40, along which the sheet member P is transported.

The feed roller 62 feeds a sheet member P accommodated in the storage part 50 to the paper feed path 40. The multiple transport rollers 64 transport the sheet member P, fed to the paper feed path 40 by the feed roller 62, to the chain gripper 66.

Chain Gripper 66

The chain gripper 66 transports the sheet member P, transported from the paper feed mechanism 48, to a paper output path 42 through the transfer device 30 and the fixing device 100 (described below). The chain gripper 66 is an example of a transport part. As shown in FIG. 1, the chain gripper 66 includes a pair of chains 72, pairs of sprockets 71, 73, 92, 94, and 96, and grip units 68 (see FIG. 2) each having grip members 76 that grip the leading end of the sheet member P.

Figure 2:
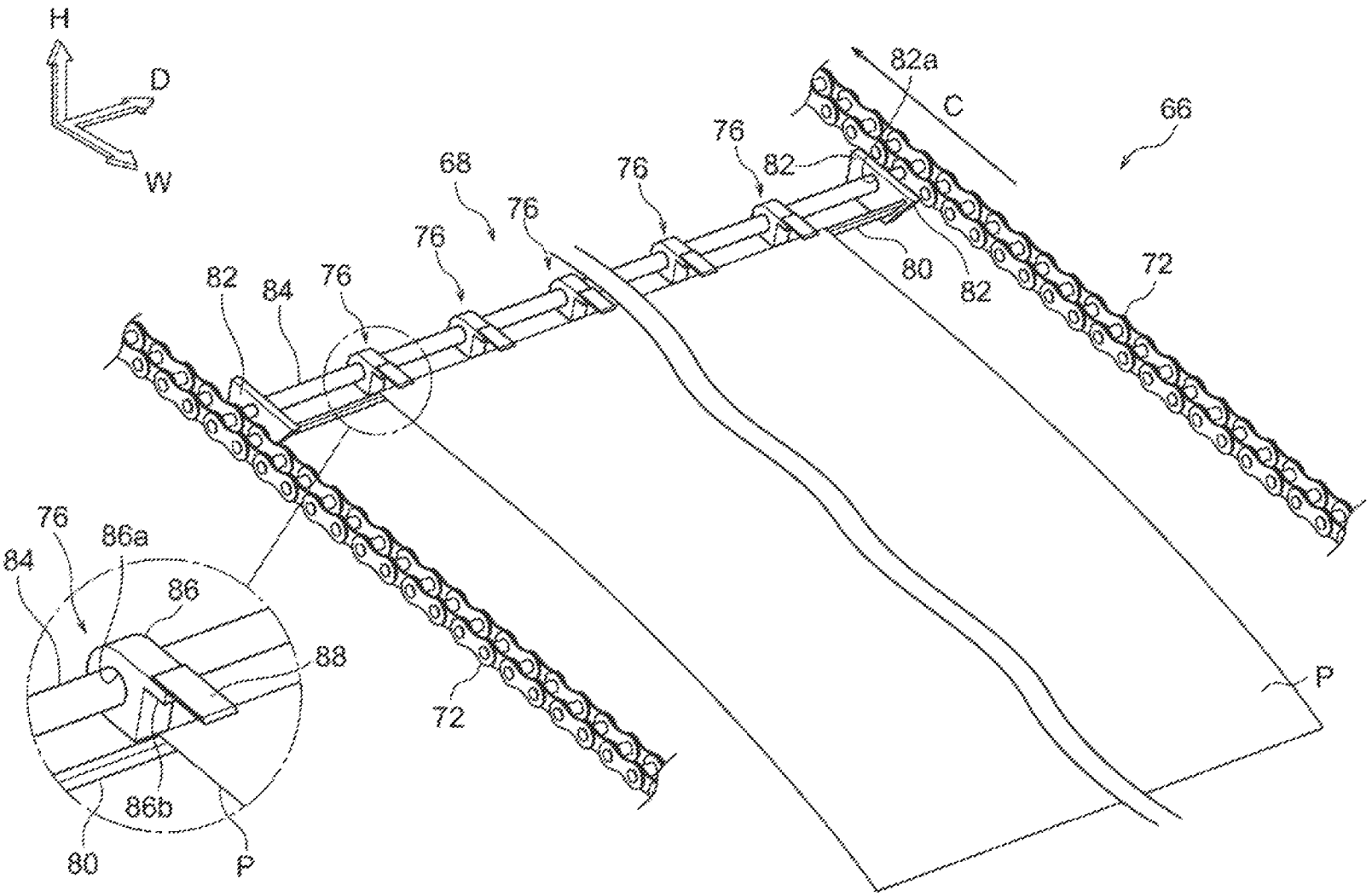
FIG. 2 is a perspective view of a transport part according to the first exemplary embodiment of the present disclosure.
Figure 3:
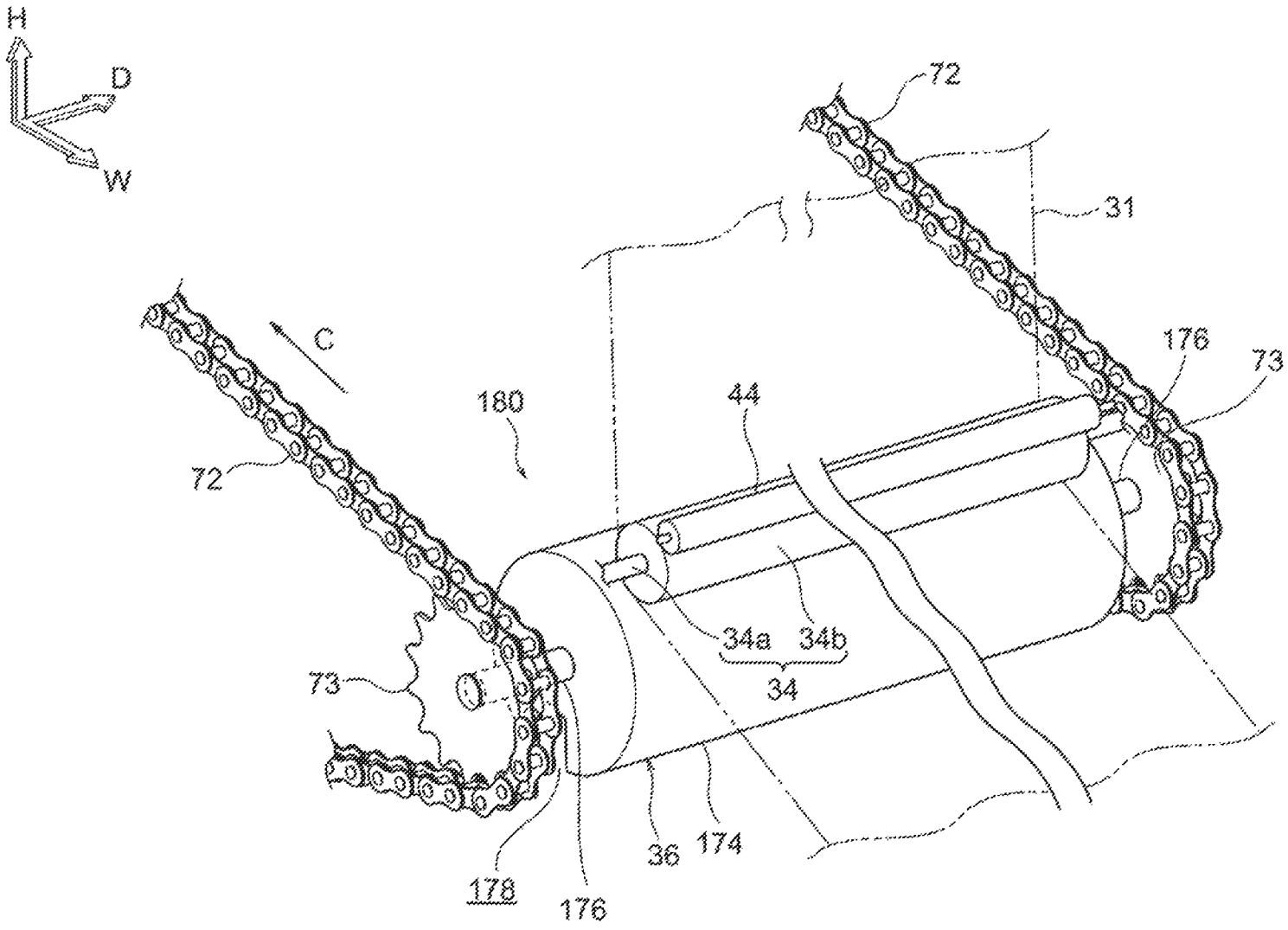
FIG. 3 is a perspective view of an opposing roller and a second transfer roller according to the first exemplary embodiment of the present disclosure.

As shown in FIG. 2, the chains 72 are endless chains (see FIG. 1) and are disposed at a distance from each other in the depth direction. As shown in FIG. 3, the chains 72 are wound on the pair of sprockets 73, which are disposed at one end and the other end of an opposing roller 36 (described below) in the axial direction and have axes extending in the depth direction. Furthermore, as shown in FIG. 1, the chains 72 are wound on the pair of sprockets 71, which are disposed at one end and the other end of a pressure roller 140 (described below) in the axial direction and have axes extending in the depth direction. Furthermore, the chains 72 are wound on the pair of sprockets 92, the pair of sprockets 94, and the pair of sprockets 96, which are disposed at a distance from each other in the depth direction.

In this configuration, when a rotational force is transmitted to any one of the multiple sprockets 71, 73, 92, 94, and 96, the chains 72 revolve in the direction of arrow C so as to move from the sprocket 73 side toward the sprocket 71 side. In this exemplary embodiment, the rotational force is transmitted to the sprockets 71. In this configuration, the chain gripper 66 transports a sheet member P, gripped by a grip unit 68, in the revolving direction of the chains 72.

The grip units 68 are provided at predetermined intervals in the circumferential direction of the chains 72 (revolving direction). As shown in FIG. 2, the grip units 68 extend in the depth direction, and ends of each grip unit 68 in the depth direction are attached to the chains 72. The grip units 68 move in the revolving direction of the chains 72 as the chains 72 revolve.

As shown in FIG. 2, the grip units 68 each include a plate part 80 extending in the depth direction, a pair of support plates 82 that support the plate part 80, and a shaft member 84 extending in the depth direction and attached to the chains 72 at the ends thereof. The grip units 68 further include the grip members 76 that grip the leading end of a sheet member P between the plate part 80 and themselves.

The plate part 80 is made of stainless steel and is disposed between the chains 72. The plate part 80 is inclined with respect to the sheet transport direction such that the upstream portion thereof in the sheet transport direction is closer to the sheet member P than the downstream side thereof is, as viewed in the depth direction.

The support plates 82 are made of stainless steel and are disposed at the ends of the plate part 80 such that the thickness direction thereof corresponds to the depth direction. The ends of the plate part 80 are attached to the support plates 82, and the support plates 82 support the plate part 80. The support plates 82 have circular through-holes 82*a*.

The shaft member 84 is made of stainless steel, extends in the depth direction, and is disposed downstream of the plate part 80 in the sheet transport direction. The shaft member 84 passes through the through-holes 82*a* in the support plates 82. The ends of the shaft member 84 are attached to the chains 72.

The grip members 76 are attached to the shaft member 84 at predetermined intervals in the depth direction. The grip members 76 each include a body portion 86 having a through-hole 86*a*, through which the shaft member 84 passes, and a contact portion 88 that comes into contact with the sheet member P.

The body portion 86 is made of aluminum. A portion of the body portion 86 on the downstream side in the sheet transport direction has an arc shape as viewed in the depth direction. Furthermore, a projection 86*b* projecting toward the plate part 80 is provided at an upstream portion of the body portion 86 in the sheet transport direction, the portion located outside the endless chains 72 (that is, the side opposite to the side surrounded by the endless chains 72 as viewed in the depth direction). The projection 86*b* has a rectangular shape as viewed in the direction in which it projects.

The contact portion 88 is a stainless-steel plate member attached to a side of the projection 86*b* facing outside of the endless chains 72. The contact portion 88 projects from the projection 86*b* toward the plate part 80 and is in contact with the plate part 80 from the outside of the endless chains 72.

In this configuration, a cam mechanism (not shown) rotates the shaft member 84 to press the contact portions 88 against the plate part 80 from the outside of the endless chains 72 and to move the contact portions 88 away from the plate part 80. This way, the grip members 76 grip and release the leading end of the sheet member P.

Transfer Device 30

The transfer device 30 first-transfers color toner images formed on photoconductor drums 21 corresponding to the respective colors, described below, to an intermediate transfer body in a superposed manner and then second-transfers the superposed toner images to a sheet member P. As shown in FIG. 1, the transfer device 30 includes: a transfer belt 31, serving as an intermediate transfer body; multiple rollers 32; first transfer rollers 33; a second transfer roller 34; and the opposing roller 36. The transfer device 30 also includes an application roller 44, which applies a voltage to the second transfer roller 34.

As shown in FIG. 1, the transfer belt 31 is an endless belt stretched over the multiple rollers 32 and the second transfer roller 34 so as to be held in an inverted triangular orientation in front view. The transfer belt 31 revolves in the direction of arrow B when at least one of the multiple rollers 32 is rotationally driven. The photoconductor drums 21 corresponding to the respective colors are arranged on the outer circumference of the transfer belt 31.

The first transfer rollers 33 are opposed to the photoconductor drums 21 corresponding to the respective colors with the transfer belt 31 therebetween. The first transfer rollers 33 transfer toner images formed on the photoconductor drums 21 to the transfer belt 31 at first transfer positions T located between the photoconductor drums 21 and the first transfer rollers 33.

The second transfer roller 34 is disposed so as to push outward an inclined portion on one side (the left side in FIG. 1) of the transfer belt 31 in the width direction.

The second transfer roller 34, over which the transfer belt 31 is stretched, and the opposing roller 36 (described in detail below), which is opposed to the second transfer roller 34 with the transfer belt 31 therebetween, form a nip part NT therebetween. In other words, the nip part NT is formed between the opposing roller 36 and the second transfer roller 34. The second transfer roller 34, over which the transfer belt 31 is stretched, and the opposing roller 36 nip a sheet member P transported by the chain gripper 66. The second transfer roller 34 is an example of a nip member, and the opposing roller 36 is an example of a transfer drum.

The application roller 44 has a smaller diameter than the second transfer roller 34 and, as shown in FIG. 2, is disposed on the opposite side of the second transfer roller 34 from the transfer belt 31. The application roller 44 extends in the depth direction and is in contact with the second transfer roller 34.

In this configuration, the application roller 44 is rotated by the rotating second transfer roller 34. Furthermore, the application roller 44 receives, at the shaft thereof, the supply of power from a power supply (not shown) and applies a voltage to the second transfer roller 34. By applying a voltage to the second transfer roller 34, the application roller 44 forms, at the nip part NT between the second transfer roller 34 and the opposing roller 36, a transfer electric field for transferring the toner image on the transfer belt 31 to the sheet member P. In other words, the application roller 44 causes the toner image on the transfer belt 31 to be transferred to the sheet member P. The application roller 44 is an example of an application member.

Image Forming Unit 12

The image forming unit 12 forms an image to be transferred to a sheet member P by using an electrophotographic system. As shown in FIG. 10, the image forming unit 12 is disposed on the other side (on the right side in FIG. 10) with respect to the paper feed mechanism 48 in the width direction. The image forming unit 12 includes multiple toner-image forming units 20 that form toner images.

There are multiple toner-image forming units 20, so that toner images of different colors are formed. In this exemplary embodiment, four toner-image forming units 20, which correspond to yellow (Y), magenta (M), cyan (C), and black (K), are provided. In FIGS. 1 and 10, (Y), (M), (C), and (K) denote the components corresponding to these colors.

Toner-Image Forming Units 20

The toner-image forming units 20Y, 20M, 20C, and 20K have basically the same configuration except for the toners used. The toner-image forming units 20Y, 20M, 20C, and 20K include photoconductor drums 21 corresponding to the respective colors.

As shown in FIGS. 1 and 10, the toner-image forming units 20Y, 20M, 20C, and 20K are arranged side-by-side along the horizontal portion of the transfer belt 31 in an inverted triangular orientation.

The toner-image forming units 20Y, 20M, 20C, and 20K form toner images by allowing Y, M, C, and K toners to adhere to the outer circumferential surfaces of the corresponding photoconductor drums 21. The toner images formed on the photoconductor drums 21 are transferred to the transfer belt 31 at first transfer positions T between the photoconductor drums 21 and the first transfer rollers 33. In short, the image forming unit 12 including the toner-image forming units 20 forms a toner image on the transfer belt 31.

Fixing Device 100

The fixing device 100 fixes, to the sheet member P, the toner image transferred to the sheet member P by the transfer device 30.

As shown in FIG. 1, the fixing device 100 includes a preheater 102 for preheating the sheet member P transported by the chain gripper 66, a heater 120 for heating the sheet member P, and a blowing unit 170 for blowing air to the sheet member P.

Preheater 102

As shown in FIG. 1, the preheater 102 is disposed so as to face the top surface of the sheet member P that is being transported, on the downstream side of the nip part NT in the transport direction of the sheet member P (hereinbelow, the "sheet transport direction"). The preheater 102 includes a reflection member 104, multiple infrared heaters 106 (hereinbelow, the "heaters 106"), and a wire screen 112.

In this configuration, the preheater 102 heats, in a non-contact manner and from the thickness direction of the sheet member P, the sheet member P transported by the revolving chains 72.

Blowing Unit 170

As shown in FIG. 1, the blowing unit 170 is disposed so as to oppose the preheater 102 in the thickness direction of the sheet member P that is being transported, and the sheet member P that is being transported passes between the blowing unit 170 and the preheater 102. The blowing unit 170 includes multiple fans 172 arranged in the width direction of the sheet member P that is being transported and the sheet transport direction.

In this configuration, the orientation of the sheet member P that is being transported is stabilized by the fans 172 blowing air at the sheet member P.

Heater 120

As shown in FIG. 1, the heater 120 is disposed downstream of the preheater 102 in the sheet transport direction. The heater 120 includes a heating roller 130 that comes into contact with the sheet member P that is being transported to heat the sheet member P, a pressure roller 140 that presses the sheet member P against the heating roller 130, and a driven roller 150 that is rotated by the heating roller 130 to heat the heating roller 130.

In this configuration, as a result of the heating roller 130 and the pressure roller 140 nipping and transporting the sheet member P to which the toner image has been transferred, the toner image is heated and fixed to the sheet member P.

Cooling Unit 90

The cooling unit 90 cools the sheet member P heated in the fixing device 100. As shown in FIG. 10, the sheet member P to which the toner image has been fixed in the fixing device 100 is discharged outside an apparatus body 10*a* along the paper output path 42. The cooling unit 90 is disposed along the paper output path 42.

Figure 11:
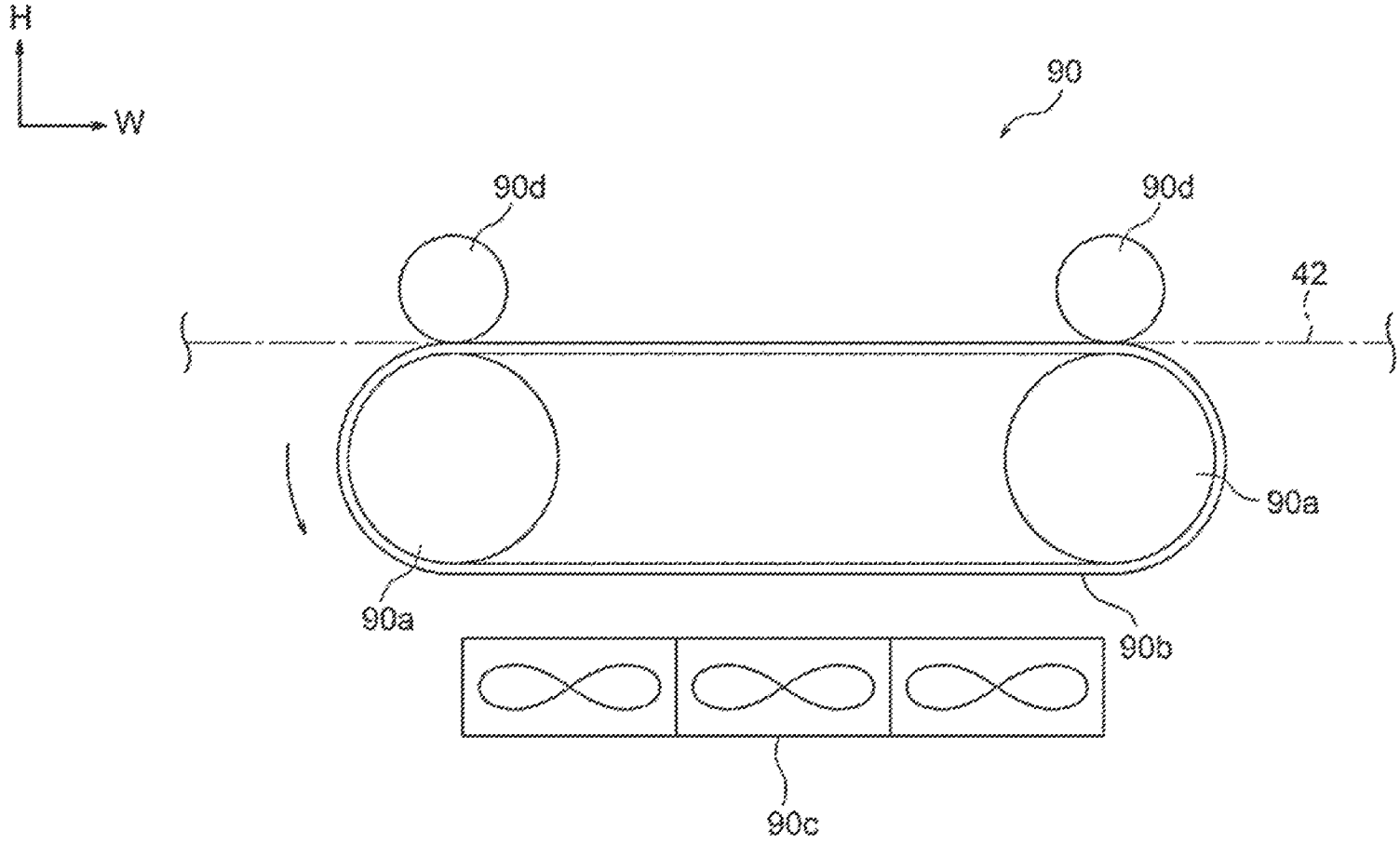
FIG. 11 is a schematic front view showing the configuration of a cooling unit according to the first exemplary embodiment of the present disclosure.

As shown in FIG. 11, the cooling unit 90 includes two rollers 90*a* arranged side-by-side in the width direction and an endless belt 90*b* stretched between the two rollers 90*a*. A top surface of the endless belt 90*b* extends along the paper output path 42. The cooling unit 90 also includes a cooling fan 90*c* that blows air at the lower surface of the belt 90*b* to cool down the belt 90*b*, and rollers 90*d* opposed to the two rollers 90*a* with the paper output path 42 and the belt 90*b* therebetween.

In this configuration, one of the two rollers 90*a* drivingly rotates. As a result, the belt 90*b* cooled by the cooling fan 90*c* runs in the direction indicated by the arrow in FIG. 11, and the rollers 90*d* are rotated by the revolving belt 90*b*. In addition, the revolving belt 90*b* and the rollers 90*d* rotated by the belt 90*b* nip and transport the sheet member P. As a result, the sheet member P is cooled.

Paper Output Mechanism 56

The paper output mechanism 56 discharges the sheet member P cooled by the cooling unit 90 to the output part 52 on the outside of the apparatus body 10*a*. As shown in FIG. 10, the paper output mechanism 56 is provided on one side (on the left side in FIG. 10) with respect to the image forming unit 12 in the width direction. The paper output mechanism 56 includes multiple transport rollers 54 that transport the sheet member P along the paper output path 42.

Relevant Part Configuration

Next, the opposing roller 36, the second transfer roller 34, and a contact mechanism 190 constituting the transfer device 30 will be described. The contact mechanism 190 is configured to bring the second transfer roller 34 into contact only with a portion on the upstream side of a recess 178 (described below) in the opposing roller 36 in the rotation direction, at a transfer-start time (described in detail below).

Opposing Roller 36

As described above, the opposing roller 36 is opposed to the second transfer roller 34 with the transfer belt 31 therebetween (see FIG. 1). As shown in FIG. 3, the opposing roller 36 extends in the depth direction.

The opposing roller 36 is made of aluminum and includes a cylindrical roller portion 174 and a pair of shafts 176 projecting from the ends of the roller portion 174 in the depth direction. The roller portion 174 is an example of an outer circumferential portion. The sprockets 73 are attached to the shafts 176.

Figure 6:
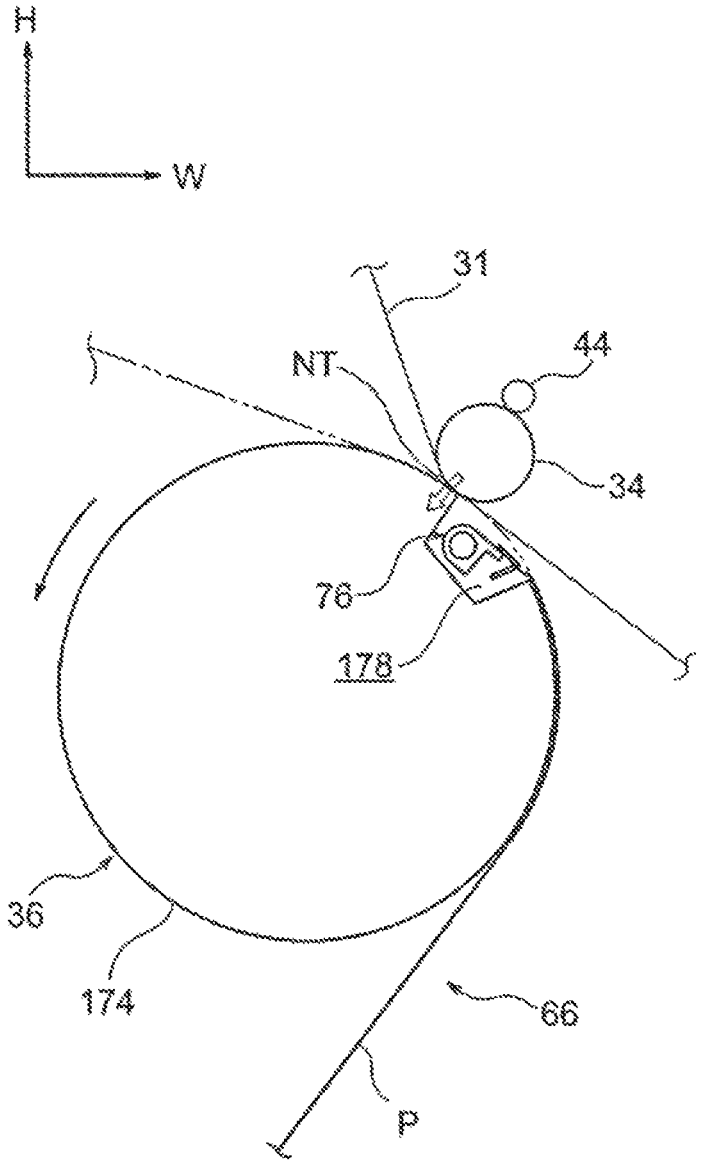
FIG. 6 is a front view showing a state in which the second transfer roller is in contact with a downstream edge of a groove portion in the opposing roller in the rotation direction according to the first exemplary embodiment of the present disclosure.

The opposing roller 36 is rotated by the revolving chains 72 of the chain gripper 66 and rotates in the revolving direction C of the chains 72 (i.e., the direction of arrow R in FIG. 6).

Figure 4:
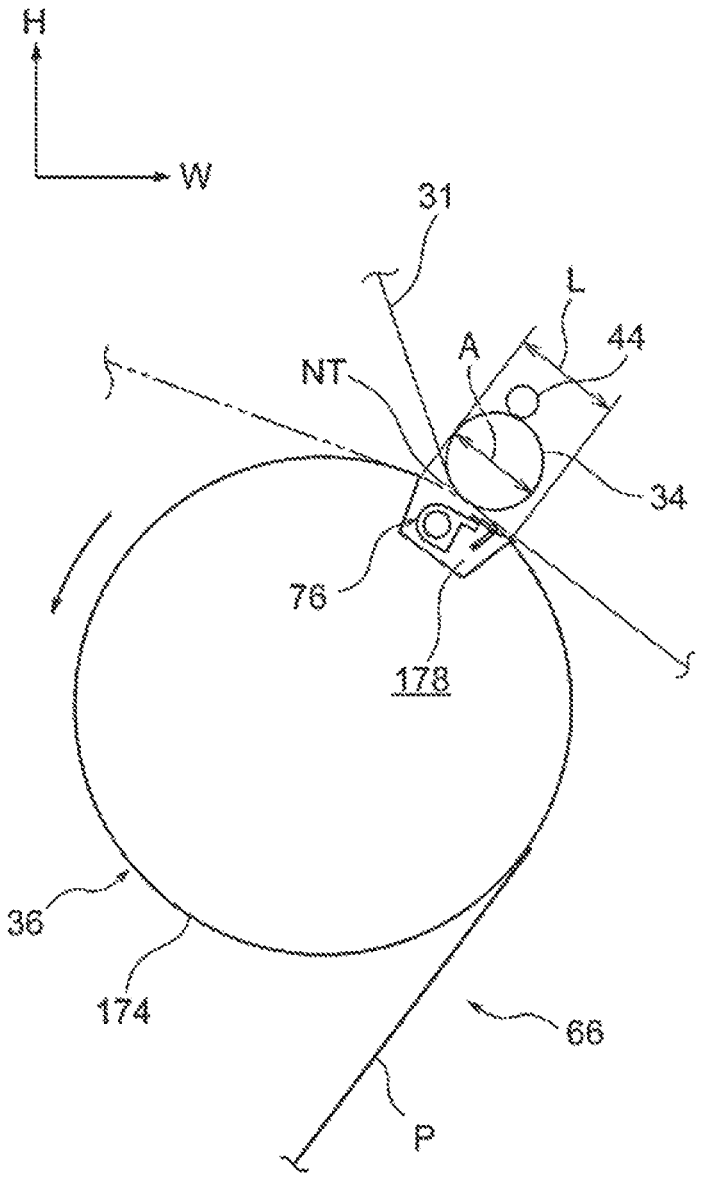
FIG. 4 is a front view of the opposing roller and the second transfer roller according to the first exemplary embodiment of the present disclosure.

As shown in FIG. 4, the roller portion 174 of the opposing roller 36 has the recess 178 capable of storing the grip members 76. The recess 178 has the shape of a groove extending from one end to the other end of the roller portion 174 in the depth direction. In the recess 178, the upstream edge of the opening in the rotation direction of the opposing roller 36 is an opening edge 178A, and the downstream edge of the opening in the rotation direction of the opposing roller 36 is an opening edge 178B. The distance between the opening edges 178A and 178B is equal to the opening width L in the rotation direction of the opposing roller 36 (circumferential direction).

Second Transfer Roller 34

As described above, the second transfer roller 34 is opposed to the opposing roller 36 with the transfer belt 31 therebetween (see FIG. 1). As shown in FIG. 3, the second transfer roller 34 includes a shaft member 34*a* extending in the depth direction and a cylindrical roller portion 34*b* extending in the depth direction and through which the shaft member 34*a* passes. The roller portion 34*b* may be columnar.

The shaft member 34*a* is a conducting shaft, and the ends of the shaft member 34*a* are supported by a frame (not shown) through bearings. The shaft member 34*a* may be made of any conducting body. Preferably, the shaft member 34*a* is made of metal, and more preferably, stainless steel.

The roller portion 34*b* is made of rubber and is attached to the shaft member 34*a* so as to rotate therewith. The roller portion 34*b* is disposed so as not to project outward from the roller portion 174 of the opposing roller 36 in the depth direction.

As shown in FIG. 4, in this exemplary embodiment, the outside diameter A of the roller portion 34*b* is smaller than the opening width L of the recess 178 in the opposing roller 36 in the circumferential direction.

Figure 7:
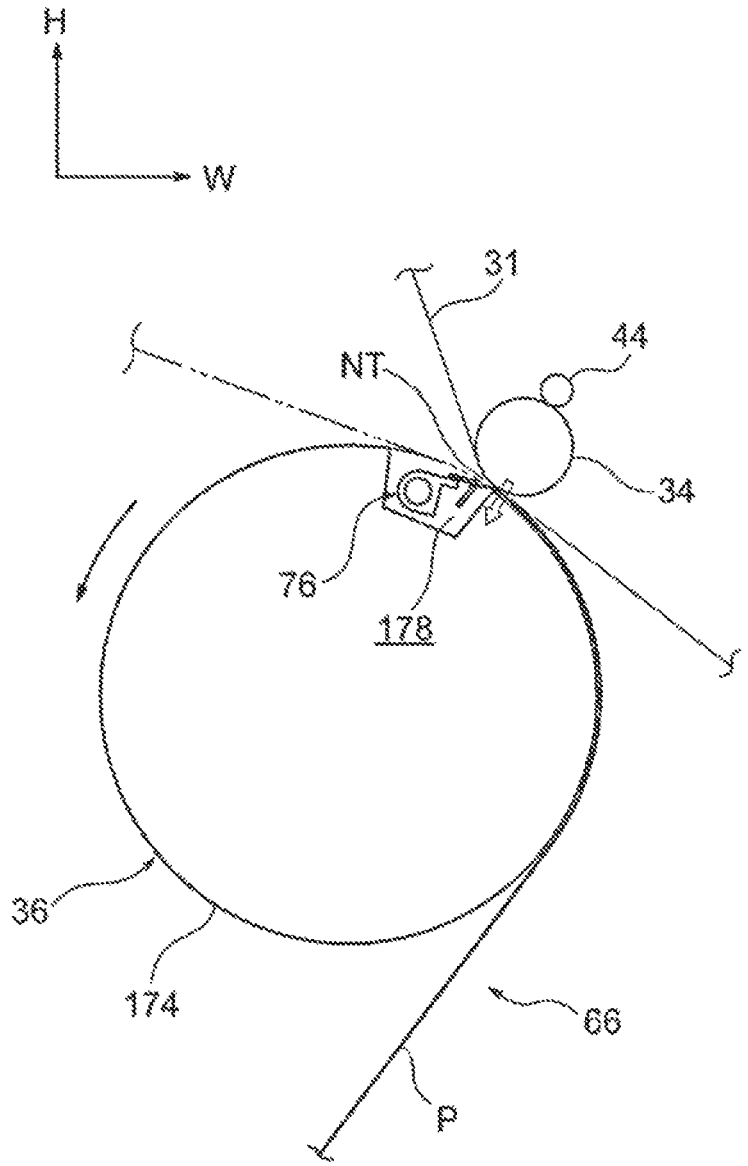
FIG. 7 is a front view showing a state of the opposing roller, the second transfer roller, and the sheet member at a transfer-start time according to the first exemplary embodiment of the present disclosure.

By setting the relationship between the outside diameter A of the roller portion 34*b* of the second transfer roller 34 and the opening width L of the recess 178 in the opposing roller 36 as above, when the second transfer roller 34 is in contact with one of the opening edges 178A and 178B of the recess 178, the second transfer roller 34 is not in contact with the other. More specifically, as shown in FIG. 6, when the second transfer roller 34 is in contact with a portion on the downstream side of the recess 178 in the opposing roller 36 in the rotation direction, the second transfer roller 34 is not in contact with a portion on the upstream side of the recess 178 in the opposing roller 36 in the rotation direction. Furthermore, as shown in FIG. 7, when the second transfer roller 34 is in contact with the portion on the upstream side of the recess 178 in the opposing roller 36 in the rotation direction, the second transfer roller 34 is not in contact with the portion on the downstream side of the recess 178 in the opposing roller 36 in the rotation direction. This setting that the outside diameter A of the roller portion 34*b* of the second transfer roller 34 is smaller than the opening width L of the recess 178 in the opposing roller 36 serves as the contact mechanism 190 according to this exemplary embodiment.

Transfer Action to Sheet Member P

Next, a transfer action of transferring a toner image to a sheet member P with the image forming apparatus 10 and the transfer device 30 according to this exemplary embodiment will be described.

First, in the image forming unit 12, color toner images are formed on the photoconductor drums 21 of the toner-image forming units 20Y, 20M, 20C, and 20K, and the color toner images are first-transferred to the transfer belt 31 in a superposed manner.

A sheet member P is fed out from the storage part 50 into the paper feed path 40 by the feed roller 62 and is transported by the transport rollers 64 to the chain gripper 66. The sheet member P passed to the chain gripper 66 is transported to the nip part NT between the second transfer roller 34, over which the transfer belt 31 is stretched, and the opposing roller 36. At this time, the grip members 76 of the chain gripper 66 grip the leading end of the sheet member P (see FIG. 2).

Figure 5:
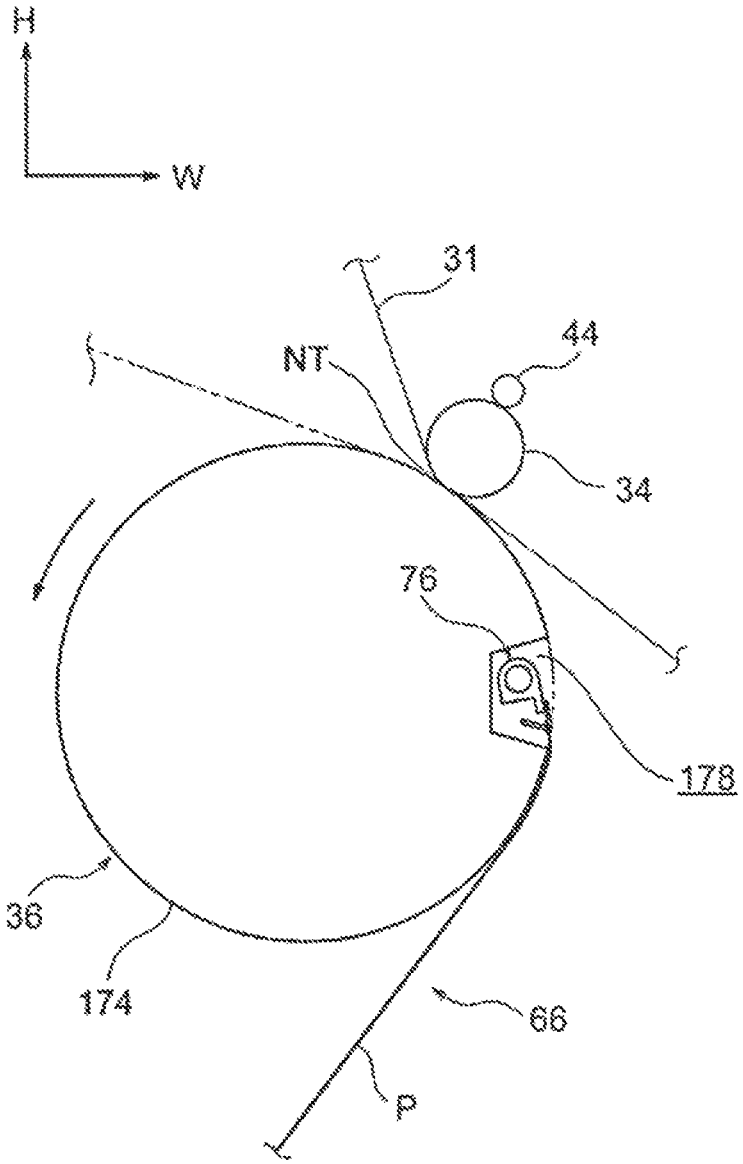
FIG. 5 is a front view showing a state of the opposing roller and the second transfer roller when a sheet member is transported to a nip part according to the first exemplary embodiment of the present disclosure.

As shown in FIG. 5, upon arrival at the opposing roller 36, the grip members 76 gripping the sheet member P are stored in the recess 178 in the roller portion 174. The chain gripper 66 transports the sheet member P toward the nip part NT with the grip members 76 stored in the recess 178. The opposing roller 36 is rotated by the revolving chains 72 of the chain gripper 66 and rotates with the grip members 76 stored in the recess 178. At this time, as shown in FIGS. 6 and 7, the opposing roller 36 allows the nip part NT to transport the sheet member P, which is gripped and transported by the grip members 76, while allowing the sheet member P to be wound on the rotating roller portion 174. At this time, the second transfer roller 34 is in contact with the portion on the downstream side of the recess 178 in the opposing roller 36 in the rotation direction with the transfer belt 31 therebetween.

As shown in FIGS. 6 and 7, as the opposing roller 36 rotates from this state, the portion of the opposing roller 36 in contact with the second transfer roller 34 changes from the portion on the downstream side of the recess 178 in the rotation direction to the portion on the upstream side of the recess 178 in the rotation direction.

When the second transfer roller 34, over which the transfer belt 31 is stretched, comes into contact with the opening edge 178A of the recess 178, as shown in FIG. 7, the sheet member P gripped by the grip members 76 is nipped between the second transfer roller 34 and the opposing roller 36. At this time, the application roller 44 applies a voltage to the nip part NT between the second transfer roller 34 and the opposing roller 36, at which the sheet member P is nipped, forming a transfer electric field. When the transfer electric field is formed at the nip part NT, the toner image on the transfer belt 31 stretched over the second transfer roller 34 starts to be transferred to the sheet member P. Herein, the timing when a transfer electric field is formed at the nip part NT between the second transfer roller 34 and the opposing roller 36 where the sheet member P is nipped, and the toner image on the transfer belt 31 starts to be transferred to the sheet member P will be referred to as the transfer-start time.

At the transfer-start time, because of the shape of the second transfer roller 34 and the shape of the recess 178, the second transfer roller 34 is in contact only with the portion on the upstream side of the recess 178 in the opposing roller 36 in the rotation direction.

Figure 8:
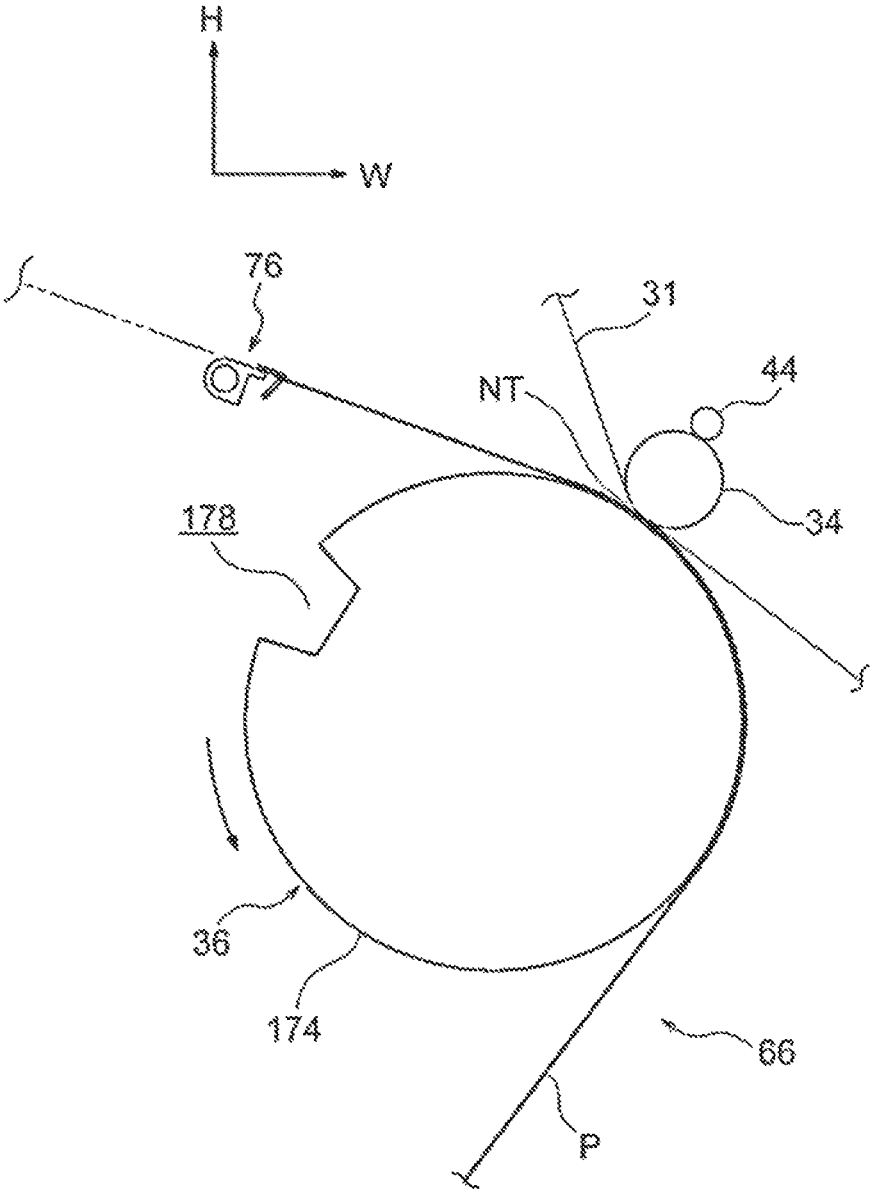
FIG. 8 is a front view showing a state of the sheet member to which the transfer device is transferring an image according to the first exemplary embodiment of the present disclosure.

After the transfer-start time, the toner image on the transfer belt 31 is transferred to the sheet member P with the revolution of the chain gripper 66, the revolution of the transfer belt 31, and the rotation of the opposing roller 36. As shown in FIG. 8, the grip members 76 stored in the recess 178 in the opposing roller 36 are released from the recess 178 as the opposing roller 36 rotates. The grip members 76 released from the recess 178 move in the revolving direction of the chains 72 (arrow C) and transport the sheet member P. The transfer of the toner image to the sheet member P with the transfer device 30 is completed when the sheet member P that is being transported exits the nip part NT.

Effects and Advantages

Next, the effects and advantages with this exemplary embodiment will be described. In this description, when a comparison example with respect to this exemplary embodiment will be explained using the same components as those in the image forming apparatus 10 according to this exemplary embodiment, the same reference signs and names of such components will be used.

The transfer device 30 of the image forming apparatus 10 according to this exemplary embodiment includes the contact mechanism 190, which causes the second transfer roller 34 to come contact only with the portion on the upstream side of the recess 178 in the opposing roller 36 in the rotation direction at the transfer-start time. The image forming apparatus 10 according to this exemplary embodiment and an image forming apparatus 210 according to a comparison example will be compared below.

Figure 9:
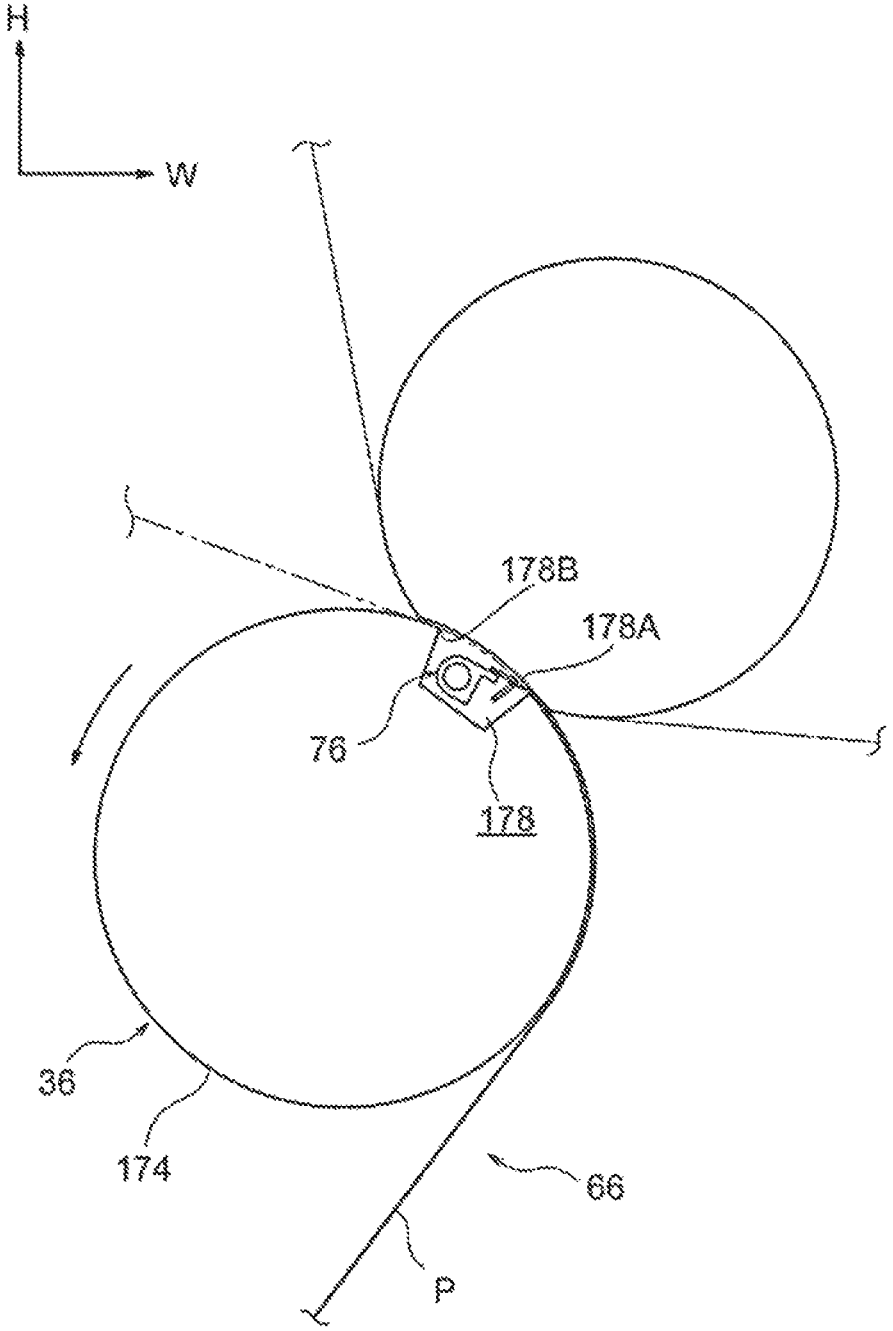
FIG. 9 is a front view showing a state of an opposing roller, a second transfer roller, and a sheet member at the transfer-start time in a comparison apparatus with respect to the first exemplary embodiment of the present disclosure.

As shown in FIG. 9, the image forming apparatus 210 according to a comparison example includes, instead of the transfer device 30 of the image forming apparatus 10, a transfer device 230, in which a second transfer roller 234 comes into contact with the portions on both the upstream and downstream sides of the recess 178 in the opposing roller 36 in the rotation direction at the transfer-start time. More specifically, the transfer device 230 according to the comparison example includes, instead of the second transfer roller 34, the second transfer roller 234, in which the outside diameter of a roller portion 234*b* is larger than the opening width L of the recess 178. In other words, the transfer device 230 according to the comparison example does not have the contact mechanism 190. Except for this structure, the image forming apparatus 210 according to the comparison example and the image forming apparatus 10 according to this exemplary embodiment have the same configuration.

In the transfer device 230 according to the comparison example, at the transfer-start time, the second transfer roller 234 is in contact with the portions on both the upstream and downstream sides of the recess 178 in the opposing roller 36. At this time, when the application roller 44 applies a voltage, and a current flows through the second transfer roller 234, the current is split into a current flowing through a sheet member P and a current flowing through the portion on the downstream side of the recess 178 in the opposing roller 36 in the rotation direction at the transfer-start time. Hence, in the transfer device 230 according to the comparison example, the transfer electric field formed in the sheet member P at the transfer-start time is smaller than the transfer electric field formed when all the current flowing from the application roller 44 flows to the opposing roller 36 through the sheet member P. If the transfer electric field formed in the sheet member P is small, a transfer error of the toner image formed on the transfer belt 31 to the sheet member P may occur. In addition, in the image forming apparatus 210 having the transfer device 230 according to the comparison example, an image formation error due to the transfer error occurring in transferring an image to a sheet member P may occur.

In contrast, the transfer device 30 according to this exemplary embodiment includes the contact mechanism 190. More specifically, at the transfer-start time, the second transfer roller 34 comes into contact only with the portion on the upstream side of the recess 178 in the opposing roller 36 in the rotation direction and does not come into contact with the portion on the downstream side of the recess 178 in the rotation direction. Hence, all the current flowing from the application roller 44 to the second transfer roller 34 flows to the opposing roller 36 through the sheet member P at the transfer-start time, and the transfer electric field formed in the sheet member P does not become small. Because the transfer device 30 according to this exemplary embodiment includes the contact mechanism 190, it is possible to prevent a transfer error due to splitting of the transfer current occurring in transferring an image to a sheet member P.

Furthermore, in the image forming apparatus 10 having the transfer device 30 according to this exemplary embodiment, it is possible to prevent an image formation error due to the transfer error occurring in transferring an image to a sheet member P.

Furthermore, in the transfer device 30 according to this exemplary embodiment, the contact mechanism 190 is formed by making the second transfer roller 34 have such a shape that it does not come into contact with the portion on the downstream side of the recess 178 in the opposing roller 36 in the rotation direction at the transfer-start time. Hence, with the transfer device 30 according to this exemplary embodiment, compared with a configuration in which the contact mechanism moves the second transfer roller so as not to come into contact with the portion of the opposing roller on the downstream side of the recess in the rotation direction at the transfer-start time, it is possible to suppress a transfer error with a simple configuration.

Furthermore, in the transfer device 30 according to this exemplary embodiment, the contact mechanism 190 is formed by making the outside diameter A of the roller portion 34*b* smaller than the opening width L of the recess 178 in the opposing roller 36 in the circumferential direction. Hence, with the transfer device 30 according to this exemplary embodiment, compared with a configuration in which the outside diameter of the second transfer roller is larger than the opening width of the recess in the opposing roller in the circumferential direction, it is possible to suppress a transfer error with a simple configuration.

Second Exemplary Embodiment

Next, an example of a transfer device and an example of an image forming apparatus according to a second exemplary embodiment of the present disclosure will be described with reference to FIG. 12. In the second exemplary embodiment, portions different from the first exemplary embodiment will be described in detail. Furthermore, when the same components as those of the image forming apparatus 10 according to the first exemplary embodiment will be used in the description of the second exemplary embodiment, the reference signs and the names of such components will be used.

Image Forming Apparatus 310

An image forming apparatus 310 includes a transfer device 330, instead of the transfer device 30 in the image forming apparatus 10. As shown in FIG. 12, the transfer device 330 includes a second transfer roller 334, instead of the second transfer roller 34 in the transfer device 30. The second transfer roller 334 is an example of a nip member. The transfer device 330 also includes a switching part 360 that switches between ON/OFF of the application of voltage by the application roller 44 depending on the state of the second transfer roller 334.

Second Transfer Roller 334

The second transfer roller 334 includes a cylindrical roller portion 334*b* instead of the roller portion 34*b* of the second transfer roller 34. The roller portion 334*b* may be columnar.

Figure 12:
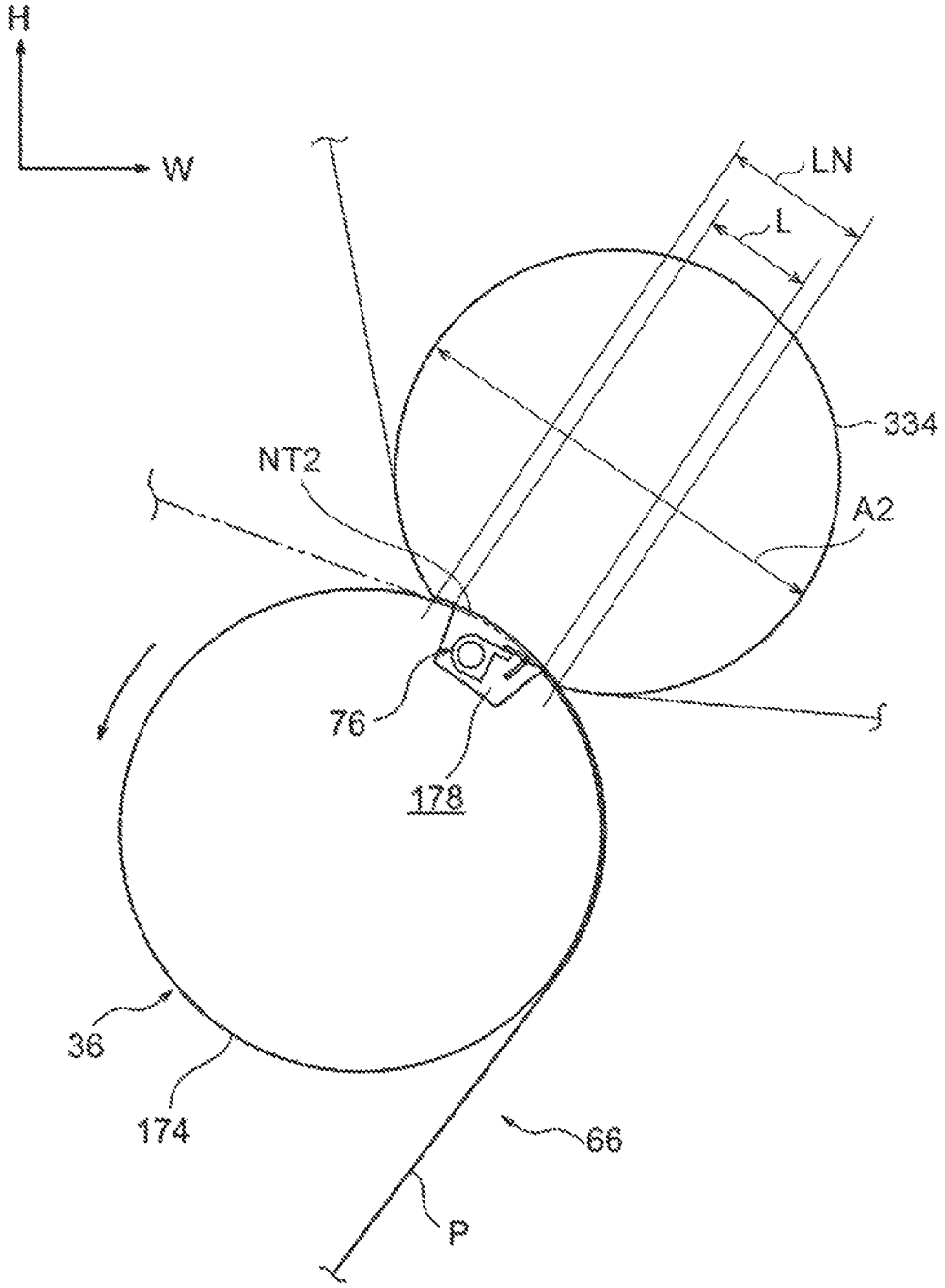
FIG. 12 is a front view showing a state of an opposing roller, a second transfer roller, and a sheet member at the transfer-start time according to a second exemplary embodiment of the present disclosure.

In this exemplary embodiment, as shown in FIG. 12, the outside diameter A2 of the roller portion 334*b* is larger than the opening width L of the recess 178 in the opposing roller 36 in the circumferential direction.

The second transfer roller 334, over which the transfer belt 31 is stretched, and the opposing roller 36 opposed to the second transfer roller 334 with the transfer belt 31 therebetween form a contact portion NT2 therebetween. A contact width LN, which is the distance between the ends of the contact portion NT2 in the circumferential direction of the opposing roller 36, is larger than the opening width L of the recess 178. In other words, the second transfer roller 334 according to this exemplary embodiment has such a size and shape that it extends over the recess 178 in the circumferential direction.

Switching Part 360

The switching part 360 includes a detection part (not shown). The detection part (not shown) includes, for example, a sheet sensor disposed between the paper feed path 40 and the opposing roller 36. The switching part 360 is configured to switch off the application of voltage with the application roller 44 except for the time when a toner image is transferred to the sheet member P. The switching part 360 is configured to switch on the application of voltage with the application roller 44 after a predetermined period of time has elapsed since the sheet sensor of the detection part detected the leading end of a sheet member P. The predetermined period of time is the time needed for the leading end of a sheet member P to be transported from the detection position, where the sheet sensor performs detection, to the position where the leading end of the sheet member P is nipped between the opposing roller 36 and the second transfer roller 334 that is in contact only with the portion on the upstream side of the recess 178 in the opposing roller 36 in the rotation direction. In other words, in a state in which the second transfer roller 334 and the opposing roller 36 nip the leading end of the sheet member P and in which the second transfer roller 334 is in contact with the portions on both the upstream and downstream sides of the recess 178 in the opposing roller 36 in the rotation direction, the switching part 360 switches off the application of voltage with the application roller 44.

By switching on the application of voltage with the application roller 44 at the above-described timing, the switching part 360 produces a transfer electric field at the contact portion NT2 to start transfer of the toner image on the transfer belt 31, stretched over the second transfer roller 334, to the sheet member P. In other words, in this exemplary embodiment, the timing when the switching part 360 switches on the application of voltage with the application roller 44 is the transfer-start time. Furthermore, as a result of the switching part 360 switching on the application of voltage with the application roller 44 at this timing, the second transfer roller 334 comes into contact only with the portion on the upstream side of the recess 178 in the opposing roller 36 in the rotation direction at the transfer-start time. The switching part 360 in this exemplary embodiment is an example of the contact mechanism.

The switching part 360 keeps the application of voltage with the application roller 44 on from the transfer-start time to the time when the sheet member P leaves the contact portion NT2. When the sheet member P leaves the contact portion NT2, the switching part 360 switches off the application of voltage with the application roller 44.

The image forming apparatus 310 according to the second exemplary embodiment has the same configuration as the image forming apparatus 10 according to the first exemplary embodiment, except for the points explained above.

Transfer Action to Sheet Member P

Next, a transfer action of transferring a toner image to a sheet member P with the image forming apparatus 310 and the transfer device 330 according to this exemplary embodiment will be described.

First, in the image forming unit 12, color toner images are formed on the photoconductor drums 21 of the toner-image forming units 20Y, 20M, 20C, and 20K, and the color toner images are first-transferred to the transfer belt 31 in a superposed manner.

A sheet member P is fed from the storage part 50 to the paper feed path 40 by the feed roller 62, is transported by the transport rollers 64, and is passed to the chain gripper 66. The sheet member P passed to the chain gripper 66 is then transported toward the contact portion NT2 between the second transfer roller 334, over which the transfer belt 31 is stretched, and the opposing roller 36. At this time, the grip members 76 of the chain gripper 66 grip the leading end of the sheet member P (see FIG. 2).

Upon arrival at the opposing roller 36, the grip members 76 gripping the sheet member P are stored in the recess 178 in the roller portion 174. The chain gripper 66 transports the sheet member P toward the contact portion NT2 with the grip members 76 stored in the recess 178. The opposing roller 36 is rotated by the revolving chains 72 of the chain gripper 66 and rotates with the grip members 76 stored in the recess 178. At this time, the opposing roller 36 causes the contact portion NT2 to transport the sheet member P, which is gripped and transported by the grip members 76, while allowing the sheet member P to be wound on the rotating roller portion 174. Furthermore, at this time, the second transfer roller 334 is in contact with the portion on the downstream side of the recess 178 in the opposing roller 36 in the rotation direction with the transfer belt 31 therebetween. At this time, the switching part 360 switches off the application of voltage with the application roller 44.

As shown in FIG. 12, as the opposing roller 36 rotates from this state, the portion of the second transfer roller 334 in contact with the opposing roller 36 becomes in a state of extending over the recess 178 in the circumferential direction. At this time, the second transfer roller 334 and the opposing roller 36 nip the sheet member P, and the second transfer roller 334 is in contact with the portions on both the upstream and downstream sides of the recess 178 in the opposing roller 36 in the circumferential direction. Hence, the switching part 360 keeps the application of voltage with the application roller 44 switched off.

After this, while the sheet member P is kept nipped between the second transfer roller 334 and the opposing roller 36 as shown in FIG. 12, the second transfer roller 334 becomes in a state of being in contact only with the portion on the upstream side of the recess 178 in the opposing roller 36 in the rotation direction as the opposing roller 36 rotates. At this time, the switching part 360 switches on the application of voltage with the application roller 44, and transfer of the toner image on the transfer belt 31, stretched over the second transfer roller 334, to the sheet member P is started. In other words, the switching part 360 is configured to allow the transfer of a toner image to a sheet member P to be started after a state in which the second transfer roller 334 extends over the recess 178 is eliminated.

Then, as shown in FIG. 8, the grip members 76 stored in the recess 178 in the roller portion 174 are released from the recess 178 as the opposing roller 36 rotates. The grip members 76 released from the recess 178 move in the revolving direction of the chains 72 (arrow C) and transport the sheet member P. The switching part 360 keeps the application of voltage with the application roller 44 on until the sheet member P gripped by the grip members 76 leaves the contact portion NT2. After the sheet member P gripped by the grip members 76 leaves the contact portion NT2, the switching part 360 switches off the application of voltage with the application roller 44.

Effects and Advantages

Next, effects and advantages with this exemplary embodiment will be described.

The transfer device 330 according to this exemplary embodiment includes the switching part 360 configured to allow the transfer of a toner image to a sheet member P to be started after the state in which the second transfer roller 334 extends over the recess 178 is eliminated. With this configuration, all the current flowing from the application roller 44 to the second transfer roller 334 flows to the opposing roller 36 through the sheet member P at the transfer-start time. Because the transfer device 330 according to this exemplary embodiment includes the switching part 360, it is possible to prevent a transfer error due to splitting of the transfer current occurring in transferring an image to a sheet member P.

Furthermore, in the image forming apparatus 310 having the transfer device 330 according to this exemplary embodiment, it is possible to prevent an image formation error due to the transfer error occurring in transferring an image to a sheet member P.

Although specific exemplary embodiments of the present disclosure have been described in detail above, the present disclosure is not limited to the above-described exemplary embodiments, and various modifications, changes, improvements are possible within the scope of the technical idea of the present disclosure.

For example, in the above-described exemplary embodiments, the nip member is the columnar or cylindrical second transfer roller 34 or 334. However, the nip member according to the present disclosure does not necessarily have to be columnar or cylindrical. The nip member according to the present disclosure may be, for example, a charger over which the transfer belt 31 is stretched.

Furthermore, in the above-described exemplary embodiment, the application member is the application roller 44 that applies a voltage to the second transfer roller 34 or 334. However, the application member according to the present disclosure does not necessarily have to be one that applies a voltage to the second transfer roller 34 or 334. For example, instead of the application roller 44, the application member according to the present disclosure may be configured to apply, to the opposing roller 36, a voltage having an opposite polarity to the application roller 44.

Furthermore, in the configuration in which the second transfer roller has such a size and shape that it extends over the recess in the opposing roller in the circumferential direction, the contact mechanism in this configuration is not limited to the switching part 360 according to the second exemplary embodiment as long as the transfer to the sheet member P is started after the state in which the second transfer roller extends over the recess is eliminated. For example, the technical idea of the present disclosure also includes a configuration in which the application roller constantly applies a voltage to the second transfer roller, and a toner image on the transfer belt reaches a sheet member and starts to be transferred after the state in which the second transfer roller extends over the recess is eliminated. In such a configuration, an image forming unit that forms a toner image on the transfer belt such that the toner image on the transfer belt reaches a sheet member P and starts to be transferred after the state in which the second transfer roller extends over the recess is eliminated is an example of the contact mechanism.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transfer device comprising:

a transfer drum that has a groove-like recess extending in an axial direction in an outer circumferential portion thereof, rotates about an axis thereof, and comes into contact with a medium being transported at a portion thereof on an upstream side of the recess in a rotation direction;

a nip member, the nip member and the transfer drum forming therebetween a nip part where the medium is nipped; and an application member that applies a voltage to the nip part where the medium is nipped, so that an image is transferred to the medium, wherein the nip member has a columnar or cylindrical shape extending in the axial direction, and an outside diameter of the nip member is smaller than an opening width of the recess in the circumferential direction, such that the nip member comes into contact only with a portion on the upstream side of the recess in the transfer drum in the rotation direction at a transfer-start time when the transfer of the image to the medium starts.

2. The transfer device according to claim 1, wherein the nip member has such a size and shape that the nip member is not in contact with a portion on a downstream side of the recess in the transfer drum in the rotation direction at the transfer-start time.

3. An image forming apparatus comprising:

the transfer device according to claim 1;

an image forming unit that forms, on the transfer device, an image to be transferred to the medium; and a transport part that transports the medium to the nip part while gripping the medium with a grip member that can be stored in the recess.

4. An image forming apparatus comprising:

the transfer device according to claim 2;

an image forming unit that forms, on the transfer device, an image to be transferred to the medium; and a transport part that transports the medium to the nip part while gripping the medium with a grip member that can be stored in the recess.

5. A transfer device comprising:

a transfer drum that has a groove-like recess extending in an axial direction in an outer circumferential portion thereof, rotates about an axis thereof, and comes into contact with a medium being transported at a portion thereof on an upstream side of the recess in a rotation direction;

a nip roller, the nip roller and the transfer drum forming therebetween a nip part where the medium is nipped; and an application roller that applies a voltage to the nip part where the medium is nipped, so that an image is transferred to the medium, wherein the nip roller has a columnar or cylindrical shape extending in the axial direction, and an outside diameter of the nip roller is smaller than an opening width of the recess in the circumferential direction, such that the nip roller comes into contact only with a portion on the upstream side of the recess in the transfer drum in the rotation direction at a transfer-start time when the transfer of the image to the medium starts.

* * * * *